US010708684B2

(12) United States Patent
Sun et al.

(10) Patent No.: US 10,708,684 B2
(45) Date of Patent: Jul. 7, 2020

(54) AUDIO PLAY APPARATUS AND DEVICE

(71) Applicant: Huawei Technologies Co., Ltd., Shenzhen (CN)

(72) Inventors: Zhengbin Sun, Beijing (CN); Yanhui Ren, Tampere (FI); Ligang Yu, Beijing (CN); Haibo Shan, Shenzhen (CN); Meimei Han, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/342,388

(22) PCT Filed: Mar. 10, 2017

(86) PCT No.: PCT/CN2017/076330
§ 371 (c)(1),
(2) Date: Apr. 16, 2019

(87) PCT Pub. No.: WO2018/072383
PCT Pub. Date: Apr. 26, 2018

(65) Prior Publication Data

US 2019/0238973 A1 Aug. 1, 2019

(30) Foreign Application Priority Data

Oct. 17, 2016 (CN) ..... 2016 1 0905803
Nov. 18, 2016 (CN) ..... 2016 1 1018757

(51) Int. Cl.
*H04R 1/28* (2006.01)
*H04R 1/02* (2006.01)
(Continued)

(52) U.S. Cl.
CPC ..... *H04R 1/2811* (2013.01); *H04R 1/025* (2013.01); *H04R 1/10* (2013.01); *H04R 1/2803* (2013.01);
(Continued)

(58) Field of Classification Search
CPC ..... H04R 2499/11; H04R 1/28; H04R 1/2876
(Continued)

(56) References Cited

U.S. PATENT DOCUMENTS 6,508,897 B1 * 1/2003 Yamaguchi ..... B01D 39/163 156/180
2003/0211888 A1 * 11/2003 Wolinsky ..... A63F 13/12 463/41
(Continued)

FOREIGN PATENT DOCUMENTS

CN 2412337 Y 12/2000
CN 101317498 A 12/2008
(Continued)

OTHER PUBLICATIONS

Machine Translation and Abstract of Chinese Publication No. CN2412337, Dec. 27, 2000, 7 pages.
(Continued)

*Primary Examiner* — Alexander Krzystan
(74) *Attorney, Agent, or Firm* — Conley Rose, P.C.

(57) ABSTRACT

Embodiments of the present invention disclose an audio play apparatus and a device. The audio play apparatus includes a loudspeaker, a loudspeaker container, and a cavity expansion material, where the loudspeaker and the cavity expansion material are disposed in the loudspeaker container, the cavity expansion material is a fabric made of fibers with irregular holes on a surface, and holes are formed between fibers of the fabric. The fabric made of the fibers with the irregular holes on the surface is disposed in the audio play apparatus. In this way, when the audio play apparatus plays audio, by using gaps between the fibers of the fabric and the irregular holes on the surface of the fibers, a resonance frequency f0 of the audio play apparatus is reduced, and a frequency band width is increased.

5 Claims, 4 Drawing Sheets

(51) Int. Cl.
*H04R 1/10* (2006.01)
*H04R 9/02* (2006.01)
*H04R 9/06* (2006.01)

(52) U.S. Cl.
CPC ..... *H04R 9/02* (2013.01); *H04R 9/06* (2013.01); *H04R 2499/11* (2013.01)

(58) Field of Classification Search
USPC ..... 381/354, 353, 346, 337, 334
See application file for complete search history.

(56) References Cited

U.S. PATENT DOCUMENTS

| | | | | |
|---|---|---|---|---|
| 2007/0123313 | A1 | 5/2007 | Stenmark et al. | |
| 2010/0173547 | A1* | 7/2010 | Katayama | C04B 16/0633 442/1 |
| 2011/0186381 | A1 | 8/2011 | Ogawa et al. | |
| 2014/0037119 | A1* | 2/2014 | Yuasa | H04R 1/02 381/346 |
| 2015/0072723 | A1 | 3/2015 | Schöffmann et al. | |
| 2015/0271579 | A1 | 9/2015 | Papakyriacou et al. | |
| 2017/0099548 | A1* | 4/2017 | Schoeffmann | H04R 1/288 |
| 2017/0208388 | A1* | 7/2017 | Kobayashi | H04R 1/021 |
| 2018/0302731 | A1 | 10/2018 | Liu et al. | |
| 2019/0141436 | A1 | 5/2019 | Chen et al. | |

FOREIGN PATENT DOCUMENTS

| | | | |
|---|---|---|---|
| CN | 201594903 | U | 9/2010 |
| CN | 102089802 | A | 6/2011 |
| CN | 203276833 | U | 11/2013 |
| CN | 203896480 | U | 10/2014 |
| CN | 103503476 | B | 8/2016 |
| CN | 105872920 | A | 8/2016 |
| CN | 105347357 | B | 11/2017 |
| CN | 105621436 | B | 6/2018 |
| CN | 105430589 | B | 11/2018 |
| CN | 105706460 | B | 4/2019 |
| CN | 105872915 | B | 6/2019 |
| CN | 104994461 | B | 7/2019 |
| EP | 1659382 | A1 | 5/2006 |
| EP | 2073569 | A1 | 6/2009 |
| EP | 2293592 | A1 | 3/2011 |
| EP | 2333766 | A1 | 6/2011 |

OTHER PUBLICATIONS

Machine Translation and Abstract of Chinese Publication No. CN105347357, Nov. 28, 2017, 10 pages.
Machine Translation and Abstract of Chinese Publication No. CN105430589, Nov. 23, 2018, 10 pages.
Machine Translation and Abstract of Chinese Publication No. CN105621436, Jun. 12, 2018, 8 pages.
Machine Translation and Abstract of Chinese Publication No. CN105872920, Aug. 17, 2016, 6 pages.
Machine Translation and Abstract of Chinese Publication No. CN201594903, Sep. 29, 2010, 11 pages.
Machine Translation and Abstract of Chinese Publication No. CN203276833, Nov. 6, 2013, 5 pages.
Machine Translation and Abstract of Chinese Publication No. CN203896480, Oct. 22, 2014, 8 pages.
Foreign Communication From a Counterpart Application, Chinese Application No. 201611018757.9, Chinese Office Action dated May 7, 2019, 7 pages.
Foreign Communication From a Counterpart Application, European Application No. 17862321.1, Extended European Search Report dated May 31, 2019, 7 pages.
Foreign Communication From a Counterpart Application, PCT Application No. PCT/CN2017/076330, English Translation of International Search Report dated Jun. 29, 2017, 2 pages.
Foreign Communication From a Counterpart Application, PCT Application No. PCT/CN2017/076330, English Translation of Written Opinion dated Jun. 29, 2017, 3 pages.

* cited by examiner

AUDIO PLAY APPARATUS AND DEVICE

This application is a national stage of International Application No. PCT/CN2017/076330, filed on Mar. 10, 2017, which claims priority to Chinese Patent Application No. 201610905803.0, filed on Oct. 17, 2016 and Chinese Patent Application No. 201611018757.9, filed on Nov. 18, 2016. All of the aforementioned applications are hereby incorporated by reference in their entireties.

TECHNICAL FIELD

Embodiments of the present invention relate to the field of audio device technologies, and in particular, to an audio play apparatus and a device.

BACKGROUND

To improve a low frequency response of a loudspeaker, and implement a rich and smooth sound effect, a resonance frequency f0 of the loudspeaker needs to be reduced, and a frequency band width of a component needs to be increased. In the prior art, there are usually two methods. A first method is to expand a back cavity of the loudspeaker, for example, increase an external dimension of a sound box, so that the loudspeaker has a larger back cavity. A second method is to add a cavity expansion material. The cavity expansion material is added to implement virtual expansion of the back cavity of the loudspeaker. The first method is usually used in a loudspeaker with a large volume or a loudspeaker whose volume can be expanded. However, for a loudspeaker whose back cavity is difficult to be physically expanded, in particular, for a micro loudspeaker, virtual cavity expansion is usually implemented by adding the cavity expansion material.

The cavity expansion material is usually a porous, loose, and breathable object, such as natural zeolite, activated carbon, and various types of foaming bodies. Because the cavity expansion material has a large quantity of through micropores that are connected to each other, the micropores can breathe to some extent. When a sound wave is incident to a surface of the porous material, air vibration in the micropore is caused. Due to a friction resistance, a viscous resistance of air, and a heat conductivity function, a considerable amount of sound energy can be converted into thermal energy, to absorb sound and expand the cavity.

However, there are many problems in the cavity expansion material in the prior art. For example, zeolite materials are made into small balls of a micron size. However, such type of material has a low strength, and is fragile during actual use. In addition, the small balls need to be packaged into a dedicated enclosure/cavity, and the enclosure is packaged by using a dedicated cover. Raw material has a complex manufacturing technology, a low strength, high assembly difficulty, high costs, and selectivity of the enclosure. Consequently, universal applicability is low, and application of the material is limited.

SUMMARY

Embodiments of the present invention provide an audio play apparatus and a device. By using a cavity expansion material included in the audio play apparatus or an audio play apparatus of the device, a resonance frequency f0 may be reduced, and a frequency band width may be increased.

According to a first aspect, an embodiment of the present invention provides an audio play apparatus. The audio play apparatus includes a loudspeaker, a loudspeaker container, and a cavity expansion material. The loudspeaker and the cavity expansion material are disposed in the loudspeaker container, the cavity expansion material is a fabric made of fibers with irregular holes on a surface, and gaps of different sizes exist between fibers of the fabric. The fabric made of the fibers with the irregular holes on the surface is disposed in the audio play apparatus. By using the gaps between the fibers of the fabric and the irregular holes on the surface of the fibers, a resonance frequency f0 of the audio play apparatus is reduced, and a frequency band width is increased.

In a possible design, the fiber is any one or a combination of an organic fiber, an inorganic fiber, a metal fiber, a ceramic fiber, and an assorted fiber.

In a possible design, the fiber is a long fiber and/or a short fiber.

In a possible design, a cross section shape of the fiber is any one or a combination of a circular shape, an I-shape, and an elliptic shape.

In a possible design, a center structure of the fiber may be any one or a combination of a hollow structure, a solid structure, and a skin-core structure.

In a possible design, the fibers are made to the fabric in any one of needling, spunlace, melt-blown, and hot compression manners.

In a possible design, the cavity expansion material is a nonwoven fabric made of polyester porous fibers in a spunlace manner, and a fiber structure of the fabric is a short fiber of a circular cross section.

In a possible design, the cavity expansion material is a nonwoven fabric made of polyester porous fibers in a needling manner, and a fiber structure of the fabric is a short fiber of an elliptic cross section.

In a possible design, the cavity expansion material is a fabric made of polyethylene porous fibers in a composite spinning manner, or a fabric made of filaments in a machine-weaving manner, and a fiber structure of the fabric is a long fiber of a skin-core structure of an elliptic cross section.

In a possible design, the cavity expansion material is a nonwoven fabric made of glass fibers in a melt-blown manner, and a fiber structure of the fabric is a short fiber of an elliptic cross section.

In a possible design, the cavity expansion material is a fabric made of polylactide porous fibers in a spunlace manner, and a fiber structure of the fabric is a hollow short fiber woven in a composite spinning manner.

In a possible design, the cavity expansion material is a fabric made of soybean porous fibers in a needling manner, and a fiber structure of the fabric is a short fiber of an elliptic cross section.

In a possible design, the cavity expansion material is a fabric made of silver porous fibers in a needling manner, and a fiber structure of the fabric is a short fiber of an elliptic cross section.

In a possible design, the cavity expansion material is a fabric made of, in a knitting manner, assorted fibers including various types of fibers; and a fiber structure of the fabric is a short fiber of an elliptic cross section.

In a possible design, the various types of fibers specifically include: 40% silver porous fibers, 30% polyester fibers, 10% soybean fibers, and 20% glass fibers.

In a possible design, the cavity expansion material is a fabric made of long fibers and short fibers, the fabric is woven through blending, and a fiber structure of the fabric has an I-shape cross section.

In a possible design, the fabric made of the long fibers and the short fibers specifically includes: 30% long polyester fibers, 20% short carbon fibers, and 50% polypropylene fibers.

According to another aspect, a specific embodiment of the present invention provides a device. The device is a mobile phone, and the mobile phone includes the audio play apparatus provided in any one of the first aspect or the possible designs of the first aspect. The audio play apparatus is disposed in the mobile phone, so that when the mobile phone plays audio, a resonance frequency f0 of the audio play apparatus is reduced, and a frequency band width is increased.

According to another aspect, a specific embodiment of the present invention provides a device. The device is a headset, and the headset includes the audio play apparatus provided in any one of the first aspect or the possible designs of the first aspect. The audio play apparatus is disposed in the headset, so that when the headset plays audio, a resonance frequency f) of the audio play apparatus is reduced, and a frequency band width is increased.

According to the audio play apparatus and the device in the embodiments of the present invention, for the audio play apparatus, the fabric made of the fibers with the irregular holes on the surface is disposed in the audio play apparatus. In this way, when the audio play apparatus plays audio, by using the gaps between the fibers of the fabric and the irregular holes on the surface of the fibers, a resonance frequency f0 of the audio play apparatus is reduced, and a frequency band width is increased.

DESCRIPTION OF EMBODIMENTS

The technical solutions in the embodiments of the present invention are further described in detail with reference to accompanying drawings and embodiments.

Figure 1:
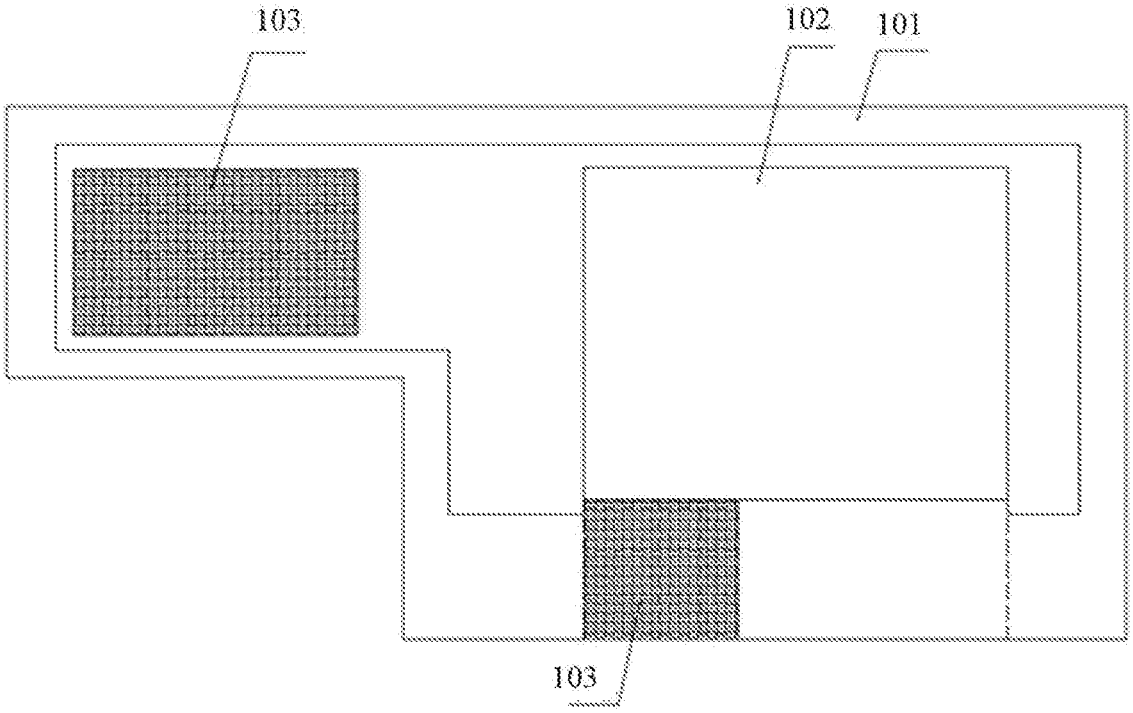
FIG. 1 shows an audio play apparatus according to a specific embodiment of the present invention.

A specific embodiment of the present invention provides an audio play apparatus and a device including the audio play apparatus. FIG. 1 shows an audio play apparatus according to a specific embodiment of the present invention. As shown in FIG. 1, the audio play apparatus includes a loudspeaker 102, a loudspeaker container 101, and a cavity expansion material 103. The loudspeaker 102 and the cavity expansion material 103 are disposed in the loudspeaker container 101. The cavity expansion material 103 is added to the loudspeaker container 101, so that a resonance frequency f0 of the loudspeaker is reduced as much as possible, and a frequency band width of a component is increased. In this way, a low frequency response of the loudspeaker is improved, and a rich and smooth sound effect is implemented, so that a high requirement for a beautiful sound is met.

Figure 2:
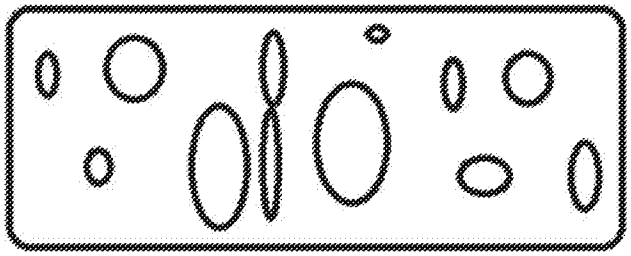
FIG. 2 is a schematic structural diagram of a fiber according to a specific embodiment of the present invention.

FIG. 2 is a schematic structural diagram of a fiber according to a specific embodiment of the present invention. As shown in FIG. 2, a surface of the fiber includes regularly-distributed micropores of different sizes. There are several micropores on each fiber base, and gaps exist between fibers of a fabric made of the fibers, and therefore a three-dimensional capillary-path mesh is formed naturally. Based on the fiber in which the micropores of different sizes are distributed on the surface, countless three-dimensional space for air absorption or releasing is established, so that virtual space similar to a real cavity is formed. In this way, fabrics made of the fibers provided in the specific embodiment of the present invention form a cavity expansion material. For the fabric made of the fibers in this specific embodiment of the present invention, costs of a raw material are low, a construction technology is simple, and the fabric is universally applicable. In addition, the loudspeaker has a lower resonance frequency f0 and a larger frequency band width. Therefore, according to an audio play apparatus and a device that includes the fabric in the present invention, virtual expansion of resonance space of the loudspeaker may be implemented, and an acoustic effect is the same as that in a method for actually expanding a back cavity of a loudspeaker apparatus.

Figure 3:
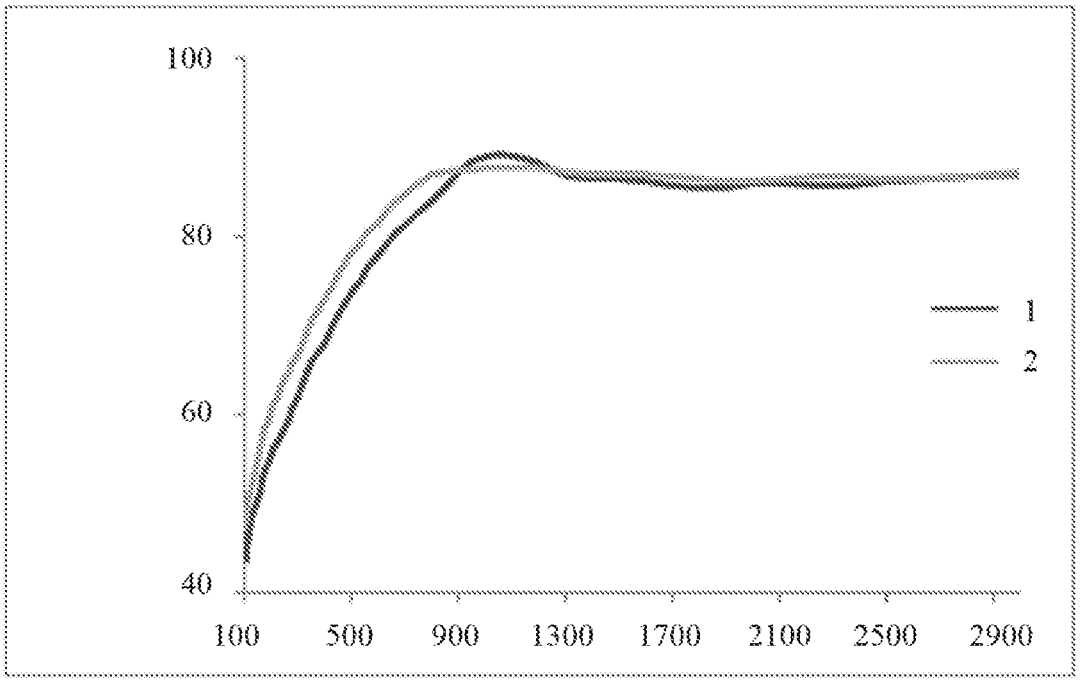
FIG. 3 is a curve diagram of a relationship between a frequency and a sound pressure level according to a specific embodiment of the present invention.

FIG. 3 is a curve diagram of a relationship between a frequency and a sound pressure level according to a specific embodiment of the present invention. As shown in FIG. 3, a horizontal axis represents a frequency, and a vertical axis represents a sound pressure level. A curve 1 represents a sound pressure level curve of a loudspeaker when a fiber material is not added. A curve 2 represents a sound pressure level curve when a fabric made of fiber materials with irregular holes on a surface is added as a cavity expansion material. It may be learned from the curve 1 and the curve 2 that when a frequency of an audio play apparatus to which the cavity expansion material is added is less than 800 Hz, a sound pressure level of the audio play apparatus is significantly improved. When the frequency of the audio play apparatus to which the cavity expansion material is added is higher than 1300 Hz, the sound pressure level of the audio play apparatus can be improved. Therefore, by increasing the sound pressure level, a resonance frequency f0 is reduced, and a frequency band width is increased.

In this specific embodiment of the present invention, the fiber includes one or a combination of an organic fiber, an inorganic fiber, a metal fiber, a ceramic fiber, or an assorted fiber. A surface of the fiber is of a structure of discretely distributed micropores of different sizes. A fiber of the fabric may be a long fiber or a short fiber or both. A cross section shape of the fiber includes any one or a combination of a circular shape, an I-shape, an elliptic shape, and the like. A center structure of the fiber may be a hollow structure or a solid structure or a skin-core structure.

A cavity expansion material in this embodiment of the present invention may be a fabric made of fibers in a plurality of processing methods. The processing methods of the fibers may be processing technologies such as needling, spunlace, melt-blown, and hot compression, and the fibers are made into the fabric.

The made fabric may be a nonwoven fabric, a machine-woven fabric, a knitted fabric, and the like. A large quantity of irregularly-distributed through gaps or blind gaps exist in the fabric, and are beneficial to air inlet and outlet. The air is absorbed or released, to form virtual space, so that virtual expansion of resonant space of a loudspeaker is implemented. By using the gaps between the fibers and the holes on the surface of the fiber, an acoustic effect is the same as that in a method for actually expanding a cavity of a loudspeaker apparatus, a resonance frequency f0 of the loudspeaker is effectively reduced, and a frequency band width of a component is effectively increased, to obtain better acoustic performance.

Figure 4:
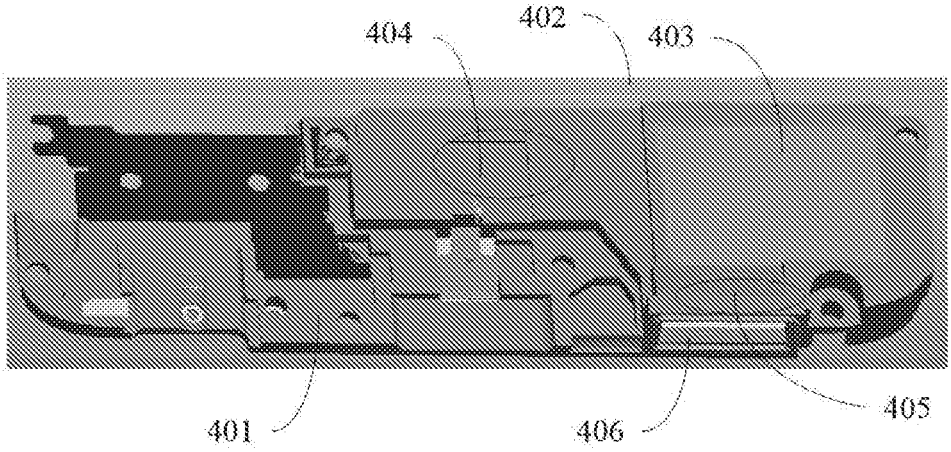
FIG. 4 shows an audio play apparatus according to a specific embodiment of the present invention.

FIG. 4 shows an audio play apparatus according to a specific embodiment of the present invention. As shown in FIG. 4, the audio play apparatus includes a connection part 401 and a cavity part 402. The connection part 401 is configured to connect the audio play apparatus and a structure of another part. The cavity part 402 includes an upper cavity body and a lower cavity body, the connection part 401 is connected to the lower cavity body, and the loudspeaker is packaged into one cavity by using the upper cavity body and the lower cavity body.

The cavity part 402 includes a first filling cavity 404, a loudspeaker cavity 403, and a sound outlet 406. A cavity expansion material is disposed in the first filling cavity 404, and a loudspeaker is disposed in the loudspeaker cavity 403. A vocal part of the loudspeaker is opposite to the sound outlet 406, a second filling cavity 405 is further disposed on the sound outlet 406, and the cavity expansion material is disposed in the second filling cavity. When the loudspeaker works, the cavity expansion material is disposed by using the first filling cavity 404 and the second filling cavity 405 on the sound outlet 406, so that a resonance frequency f0 of the loudspeaker is reduced, and a frequency band width of a component is increased.

It should be noted that the audio play apparatus described in FIG. 4 is merely an example of a specific implementation in this specific embodiment of the present invention, and sets no limitation on the present invention.

Figure 5:
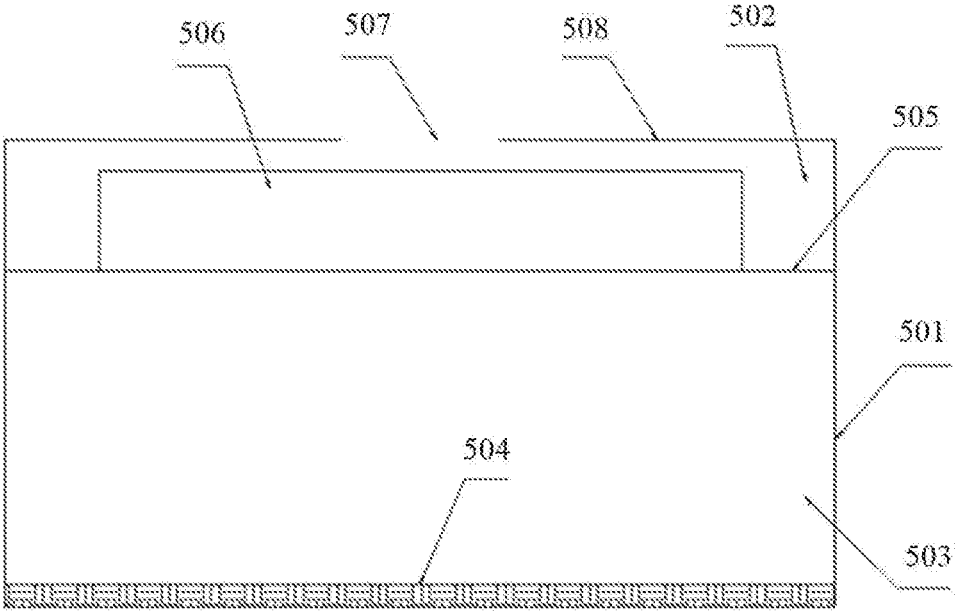
FIG. 5 shows another audio play apparatus according to a specific embodiment of the present invention.

FIG. 5 shows another audio play apparatus according to a specific embodiment of the present invention. As shown in FIG. 5, the audio play apparatus includes a back cavity 501 and a front cavity 502. The back cavity 501 is a concave structure 503. The concave structure 503 is disposed to physically expand a cavity. A cavity expansion material 504 is disposed in the concave structure 503, and virtual cavity expansion is implemented by using the cavity expansion material 504. The top of the back cavity 501 further includes a support structure 505, and the front cavity 502 is disposed on the back cavity 501 by using the support structure 505. In an example, the support structure 505 may be disposed on an edge of the top of the back cavity 501. Alternatively, the cavity expansion material may be a material disposed on the top of the entire back cavity 501, and the material is ventilated. For example, the material is the foregoing cavity expansion material.

The front cavity 502 includes an upper enclosure 508 and a loudspeaker 506. The upper enclosure 508 is sealed with and connected to the back cavity 501. The loudspeaker 506 is disposed on the support structure 505 of the back cavity 501. The upper enclosure 508 further includes a sound outlet 507. In a specific embodiment of the present invention, the cavity expansion material may be disposed in the front cavity 502. This specific embodiment of the present invention sets no limitation on a location of the cavity expansion material provided that a better audio effect is obtained.

A specific experiment is performed below on the audio play apparatus including the foregoing fabric in the present invention.

Embodiment 1

A first audio play apparatus includes a cavity expansion material. The cavity expansion material is formed by polyester porous fibers, a cross section is circular, and the fibers are short fibers. The acoustics cavity expansion material is made into a nonwoven fabric in a spunlace manner, and a weight per unit area is 0.050 grams. A resonance frequency of the first audio play apparatus is 850 Hz before the cavity expansion material is added, and the resonance frequency f0 decreases by 100 Hz after the cavity expansion material is added. A sound pressure level (SPL) at a frequency of 500 Hz is 74.50 dB before the cavity expansion material is added, and the sound pressure level (SPL) at the frequency of 500 Hz increases by 0.6 dB after the cavity expansion material is added. A sound pressure level (SPL) at a frequency of 2000 Hz is 84.3 dB before the cavity expansion material is added, and the sound pressure level (SPL) at the frequency of 2000 Hz increases by 0.25 dB after the cavity expansion material is added.

Embodiment 2

A first audio play apparatus includes a cavity expansion material. The cavity expansion material is formed by polyester porous fibers, a cross section is elliptic, and the fibers are short fibers. The acoustics cavity expansion material is made into a fabric in a needling manner, and a weight per unit area is 0.08 grams. A resonance frequency f0 of the first audio play apparatus is 880 Hz before the cavity expansion material is added, and the resonance frequency decreases by 110 Hz after the cavity expansion material is added. A sound pressure level (SPL) at a frequency of 500 Hz is 73.6 dB before the cavity expansion material is added, and the sound pressure level (SPL) at the frequency of 500 Hz increases by 0.70 dB after the cavity expansion material is added. A sound pressure level (SPL) at a frequency of 2000 Hz is 83.8 dB before the cavity expansion material is added, and the sound pressure level (SPL) at the frequency of 2000 Hz increases by 0.30 dB after the cavity expansion material is added.

Embodiment 3

A first audio play apparatus includes a cavity expansion material. The cavity expansion material is formed by polyethylene porous fibers, a cross section is elliptic, and the fibers are of a skin-core structure. In the acoustic cavity expansion material, filaments are extruded in a composite spinning manner, a fabric is made in a machine-weaving manner, and a weight per unit area is 0.10 grams. A resonance frequency f) of the first audio play apparatus is 830 Hz before the cavity expansion material is added, and the resonance frequency f0 decreases by 95 Hz after the cavity expansion material is added. A sound pressure level (SPL) at a frequency of 500 Hz is 74.10 dB before the cavity expansion material is added, and the sound pressure level (SPL) at the frequency of 500 Hz increases by 0.75 dB after the cavity expansion material is added. A sound pressure level (SPL) at a frequency of 2000 Hz is 83.5 dB before the cavity expansion material is added, and the sound pressure level (SPL) at the frequency of 2000 Hz increases by 0.32 dB after the cavity expansion material is added.

Embodiment 4

A first audio play apparatus includes a cavity expansion material. The cavity expansion material is formed by glass fibers, a cross section is elliptic, and the fibers are short fibers. The acoustics cavity expansion material is made into a nonwoven fabric in a melt-blown manner, and a weight per unit area is 0.12 grams. A resonance frequency f0 of the first audio play apparatus is 860 Hz before the cavity expansion material is added, and the resonance frequency f) decreases by 125 Hz after the cavity expansion material is added. A sound pressure level (SPL) at a frequency of 500 Hz is 72.50 dB before the cavity expansion material is added, and the sound pressure level (SPL) at the frequency of 500 Hz increases by 0.90 dB after the cavity expansion material is added. A sound pressure level (SPL) at a frequency of 2000 Hz is 81.4 dB before the cavity expansion material is added, and the sound pressure level (SPL) at the frequency of 2000 Hz increases by 0.45 dB after the cavity expansion material is added.

Embodiment 5

A first audio play apparatus includes a cavity expansion material. The cavity expansion material is formed by polylactide porous fibers, and a structure is a hollow short fiber woven in a composite spinning manner. The acoustics cavity expansion material is woven to a fabric in a spunlace manner, and a weight per unit area is 0.05 grams. A resonance frequency f0 of the first audio play apparatus is 900 Hz before the cavity expansion material is added, and the resonance frequency f0 decreases by 95 Hz after the cavity expansion material is added. A sound pressure level (SPL) at a frequency of 500 Hz is 74.8 dB before the cavity expansion material is added, and the sound pressure level (SPL) at the frequency of 500 Hz increases by 0.50 dB after the cavity expansion material is added. A sound pressure level (SPL) at a frequency of 2000 Hz is 84.8 dB before the cavity expansion material is added, and the sound pressure level (SPL) at the frequency of 2000 Hz increases by 0.25 dB after the cavity expansion material is added.

Embodiment 6

A first audio play apparatus includes a cavity expansion material. The cavity expansion material is formed by soybean porous fibers, a cross section is elliptic, and the fibers are short fibers. The acoustics cavity expansion material is woven to a fabric in a needling manner, and a weight per unit area is 0.08 grams. A resonance frequency if of the first audio play apparatus is 890 Hz before the cavity expansion material is added, and after experiment, the resonance frequency f) decreases by 105 Hz after the cavity expansion material is added. A sound pressure level (SPL) at a frequency of 500 Hz is 72.7 dB before the cavity expansion material is added, and the sound pressure level (SPL) at the frequency of 500 Hz increases by 0.6 dB after the cavity expansion material is added. A sound pressure level (SPL) at a frequency of 2000 Hz is 82.20 dB before the cavity expansion material is added, and the sound pressure level (SPL) at the frequency of 2000 Hz decreases by 0.35 dB after the cavity expansion material is added.

Embodiment 7

A first audio play apparatus includes a cavity expansion material. The cavity expansion material is formed by silver porous fibers, a cross section is elliptic, and the fibers are short fibers. The acoustics cavity expansion material is woven to a fabric in a knitting manner, and a weight per unit area is 0.15 grams. A resonance frequency f0 of the first audio play apparatus is 940 Hz before the cavity expansion material is added, and after experiment, the resonance frequency f0 decreases by 160 Hz after the cavity expansion material is added. A sound pressure level (SPL) at a frequency of 500 Hz is 72.0 dB before the cavity expansion material is added, and the sound pressure level (SPL) at the frequency of 500 Hz increases by 0.95 dB after the cavity expansion material is added. A sound pressure level (SPL) at a frequency of 2000 Hz is 92.90 dB before the cavity expansion material is added, and the sound pressure level (SPL) at the frequency of 2000 Hz increases by 0.65 dB after the cavity expansion material is added.

Embodiment 8

A first audio play apparatus includes a cavity expansion material. The cavity expansion material is a fabric made of various types of fibers. The various types of fibers include 40% silver porous fibers, 30%, polyester fibers, 10% soybean fibers, and 20% glass fibers, in terms of weight. A cross section of the fiber is elliptic, the fibers are short fibers, and a weight per unit area is 0.08 grams. The acoustics cavity expansion material is woven to a fabric in a knitting manner. A resonance frequency ft of the first audio play apparatus is 910 Hz before the cavity expansion material is added, and the resonance frequency f0 decreases by 120 Hz after the cavity expansion material is added. A sound pressure level (SPL) at a frequency of 500 Hz is 74.8 dB before the cavity expansion material is added, and the sound pressure level (SPL) at the frequency of 500 Hz increases by 0.85 dB after the cavity expansion material is added. A sound pressure level (SPL) at a frequency of 2000 Hz is 85.2 dB before the cavity expansion material is added, and the sound pressure level (SPL) at the frequency of 2000 Hz increases by 0.50 dB after the cavity expansion material is added.

Embodiment 9

A first audio play apparatus includes a cavity expansion material. The cavity expansion material is a fabric made of long fibers and short fibers. The various types of fibers include 30% long polyester fibers, 20% short carbon fibers, and 50% polypropylene fibers, in terms of weight. A surface of the fiber is of a porous structure, a cross section is an I-shape, and an inner part is of a hollow structure. The acoustics cavity expansion material is woven to a fabric through blending, and a weight per unit area is 0.10 grams. A resonance frequency f) of the first audio play apparatus is 925 Hz before the cavity expansion material is added, and the resonance frequency f0 decreases by 110 Hz after the cavity expansion material is added. A sound pressure level (SPL) at a frequency of 500 Hz is 74.2 dB before the cavity expansion material is added, and the sound pressure level (SPL) at the frequency of 500 Hz increases by 0.75 dB after the cavity expansion material is added. A sound pressure level (SPL) at a frequency of 2000 Hz is 84.6 dB before the cavity expansion material is added, and the sound pressure level (SPL) at the frequency of 2000 Hz increases by 0.36 dB after the cavity expansion material is added.

It may be found from the foregoing embodiments that a fiber including several micropores and a fabric made of the fibers are used as the cavity expansion material, so that a resonance frequency f0 can be reduced. Virtual expansion of resonance space of a loudspeaker may be implemented, and an acoustic effect is the same as that in a method for actually expanding a back cavity of a loudspeaker apparatus.

In this specific embodiment of the present invention, the audio play apparatus including the fabric made of the fibers may be added to a device of a relatively small volume that needs the audio play apparatus. For example, the device may be a mobile phone.

When the device is the mobile phone, the loudspeaker container 604 is designed depending on available space on the mobile phone. The loudspeaker 602-1 and the cavity expansion material 602-2 are disposed on the loudspeaker.

Figure 6:
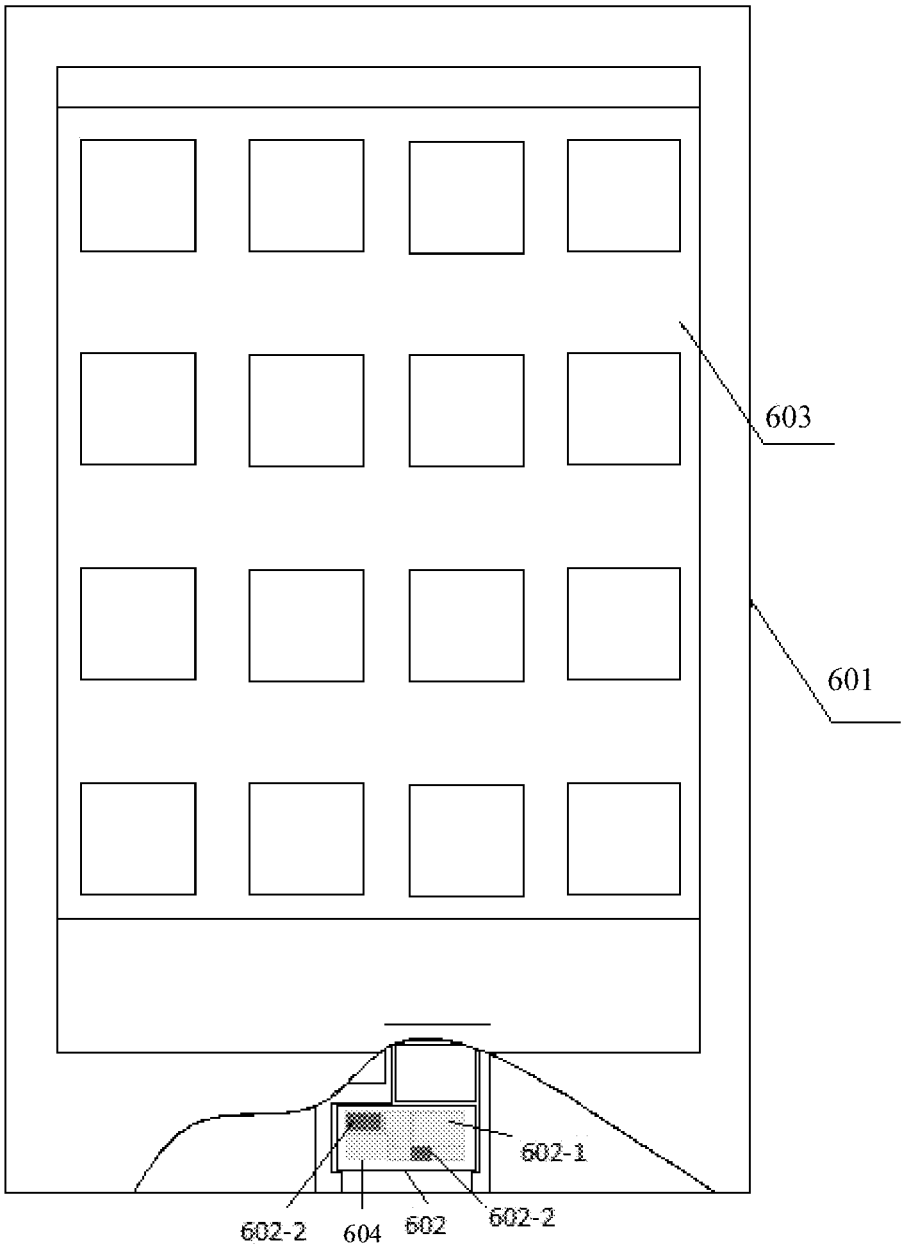
FIG. 6 is a schematic structural diagram of a mobile phone according to a specific embodiment of the present invention.

FIG. 6 is a schematic structural diagram of a mobile phone according to a specific embodiment of the present invention. As shown in FIG. 6, the mobile phone 601 includes a display screen 603, a processor, a communications module, a power supply, a camera, and an audio play apparatus 602. The power supply continuously supports running of the mobile phone 601. The communications module may be configured to transfer information between the mobile phone 601 and another device, and the communications module may include but is not limited to a baseband communications module, a Bluetooth communications module, and an NFC (Near Field Communication, Near Field Communication) module, or the like. The processor is configured to process data input to or output from the mobile phone 601. The data output from the mobile phone may be displayed by using the display screen 603, may be played by using the audio play apparatus 602, or may be displayed by using the display screen 603 and played by using the audio play apparatus 602 simultaneously. The audio play apparatus 602 may be any one of the foregoing audio play modules (as shown in FIG. 4 and FIG. 5), or may be any other audio play apparatus including a fabric made of the foregoing fibers (as shown in FIG. 2).

In another example, the device may alternatively be a headset. When the device is the headset, the loudspeaker container is an enclosure of the headset. The loudspeaker and the cavity expansion material are disposed in the enclosure of the headset.

It should be noted that a specific location of the cavity expansion material in the loudspeaker container and a specific size of the cavity expansion material need to match an actual shape and size of the loudspeaker container. This is not limited in the present invention.

In the foregoing specific implementations, the objective, technical solutions, and benefits of the present invention are further described in detail. It should be understood that the foregoing descriptions are merely specific implementations of the present invention, but are not intended to limit the protection scope of the present invention. Any modification, equivalent replacement, or improvement made without departing from the spirit and principle of the present invention should fall within the protection scope of the present invention.

What is claimed is:

1. An audio play apparatus, comprising:

a loudspeaker;

a loudspeaker container; and a cavity expansion material, wherein the loudspeaker and the cavity expansion material are disposed in the loudspeaker container, wherein the cavity expansion material is a fabric made of fibers, wherein the fibers comprise irregular holes of different sizes distributed on a surface of the fibers, wherein gaps exist between the fibers of the fabric, wherein the fabric is a fabric woven through blending, wherein a fiber structure of the fabric has an I-shape cross section, and wherein the fibers further comprise: 30% long polyester fibers, 20% short carbon fibers, and 50% polypropylene fibers.

2. A mobile phone comprising an audio play apparatus, wherein the audio play apparatus comprises:

a loudspeaker;

a loudspeaker container; and a cavity expansion material, wherein the loudspeaker and the cavity expansion material are disposed in the loudspeaker container, wherein the cavity expansion material is a fabric made of fibers, wherein the fibers comprise irregular holes of different sizes distributed on a surface of the fibers, wherein gaps exist between the fibers of the fabric, wherein the fabric is a fabric woven through blending, wherein a fiber structure of the fabric has an I-shape cross section, and wherein the fibers further comprise: 30% long polyester fibers, 20% short carbon fibers, and 50% polypropylene fibers.

3. A headset comprising an audio play apparatus, wherein the audio play apparatus comprises:

a loudspeaker;

a loudspeaker container; and a cavity expansion material, wherein the loudspeaker and the cavity expansion material are disposed in the loudspeaker container, wherein the cavity expansion material is a fabric made of fibers, wherein the fibers comprise irregular holes of different sizes distributed on a surface of the fibers, wherein gaps exist between the fibers of the fabric, wherein the fabric is a fabric woven through blending, wherein a fiber structure of the fabric has an I-shape cross section, and wherein the fibers further comprise: 30% long polyester fibers, 20% short carbon fibers, and 50% polypropylene fibers.

4. The audio play apparatus of claim 1, wherein the audio play apparatus is part of a mobile phone.

5. The audio play apparatus of claim 1, wherein the audio play apparatus is part of a headset.

* * * * *